United States Patent [19]

Kullman et al.

[11] 4,039,282

[45] Aug. 2, 1977

[54] DURABLE-PRESS FINISHING OF CELLULOSE-CONTAINING TEXTILES WITH ALUMINUM CHLORHYDROXIDE-HYDROGEN PEROXIDE CATALYST SYSTEM

[75] Inventors: Russell M. H. Kullman, Metairie; Robert M. Reinhardt, New Orleans, both of La.

[73] Assignee: The United States of America as represented by the Secretary of Agriculture, Washington, D.C.

[21] Appl. No.: 706,979

[22] Filed: July 19, 1976

[51] Int. Cl.[2] ..... D06M 13/34; B01J 23/08; B01J 27/06

[52] U.S. Cl. ..... 8/184; 8/185; 8/186; 8/187; 252/463

[58] Field of Search ..... 8/184, 185, 186, 187; 252/463

[56] References Cited

U.S. PATENT DOCUMENTS 3,909,861 10/1975 Reinhardt et al. ..... 8/184

OTHER PUBLICATIONS

Chemcon Database reference — "Catalyst System For Creasing Fully Cured Durable Press Goods" USDA ARS 72–98, 43–45, (1972).

*Primary Examiner*—John Kight, III
*Attorney, Agent, or Firm*—M. Howard Silverstein; David G. McConnell; Salvador J. Cangemi

[57] ABSTRACT

A catalyst system composed of aluminum chlorhydroxide [$Al_2(OH)_5Cl$] and hydrogen peroxide [$H_2O_2$] is disclosed which through synergistic interaction of these components is highly efficient and effective in treatments of cellulose-containing textiles with formaldehyde-amide adduct crosslinking agents. Products with durable-press properties are produced through use of the new catalyst system in treatments employing flash curing conditions, i.e., short processing times at high temperatures, as well as in treatments employing curing temperatures down to 130° C. with longer processing times. Unlike previously known synergistically activated catalyst systems based upon $Al_2(OH)_5Cl$, the presently disclosed system utilizes the combination of $Al_2(OH)_5Cl$ with $H_2O_2$, an oxidizing agent, rather than with an acid or a salt with latent acidic or Lewis acid properties.

6 Claims, No Drawings

DURABLE-PRESS FINISHING OF CELLULOSE-CONTAINING TEXTILES WITH ALUMINUM CHLORHYDROXIDE-HYDROGEN PEROXIDE CATALYST SYSTEM

BACKGROUND OF THE INVENTION

1. Field of the Invention

This invention relates to durable-press fabrics. More specifically, it relates to a catalyst system that is useful in the treatment of cellulose-containing textile materials with certain formaldehyde-amide adduct finishing agents to give valuable durable-press properties in the textile product 2. Description of the Prior Art Synergistic catalyst effects are produced when aluminum chlorhydroxide, hereinafter referred to as $Al_2(OH)_5Cl$, is used with certain salts or with certain acids. Stronger catalysis results from the use of a combination of such salts or acids and $Al_2(OH)_5Cl$ than from the use of either component alone. Reinhardt et al., U.S. Pat. No. 3,909,861, have amply demonstrated the uses of $Al_2(OH)_5Cl$ with various salts and acids. They have also pointed out that some known latent acidic catalysts, such as $Mg(H_2PO_4)_2$, and alkaline salts are ineffective in combination with $Al_2(OH)_5Cl$. These workers demonstrated a buffering effect with strong acids and an activating effect with weak acids by use of $Al_2(OH)_5Cl$. They also demonstrated the effectiveness of $Al_2(OH)_5Cl$ alone as catalyst in treatments by the conventional pad-dry-cure process at temperatures of 140° to 180° C.

Reinhardt et al., American Dyestuff Reporter 64 (May 1975), discuss $Al_2(OH)_5Cl$ catalyst systems in the specialized techniques of moist curing and steam curing and show effective curing temperatures of from 100° to 180° C. In pad-dry-cure finishing, $Al_2(OH)_5Cl$ compares favorably with $MgCl_2$, $ZnCl_2$, and $Zn(NO_3)_2$ as a catalyst. These workers, in general, teach away from curing at highly elevated temperatures when mixed catalyst systems containing $Al_2(OH)_5Cl$ are used.

Very little information is available in the literature concerning $H_2O_2$ as a catalyst for the reaction of finishing agents used in treatment of cellulose-containing textiles to obtain wash-wear, wrinkle resistance or durable-press properties. Gagliardi, American Dyestuff Reporter 40 (November 1951) lists $H_2O_2$ as one of five types of catalyst for resin finishing of fabric. He suggests that, in aqueous solutions containing free formaldehyde, $H_2O_2$ will oxidize the formaldehyde to formic acid which then catalyzes the reaction of the resin with cloth. Gagliardi states that this catalyst has not been exploited commercially; the delayed formation of formic acid from free formaldehyde is one major factor hindering such exploitation. Although Gagliardi mentions $H_2O_2$ as a catalyst no data or treatment details are presented. Apparently, very specialized conditions must be employed to obtain effective catalysis.

British Pat. No. 482,254 discloses $H_2O_2$ as a catalyst for the condensation product of urea and formaldehyde. Of particular note in the teachings of this patent is the highly restrictive method required to make the process operative. Once fabric has been impregnated with $H_2O_2$ and a water-soluble condensation product obtained from formaldehyde and urea, or similar amines or amides, it is necessary to quickly heat the wet, impregnated textile to the critical temperature range of 95°-100° C. This highly selective step is required to achieve further resin condensation in the cloth material.

In all prior work, no catalyst system has been employed that is composed of $Al_2(OH)_5Cl$ and an oxidizing agent such as $H_2O_2$. Those systems with $Al_2(OH)_5Cl$ and another component all teach away from the conventional curing temperatures employed in the pad-dry-cure process. One skilled in the teachings of the prior art would not anticipate effectiveness of $H_2O_2$ as a catalyst in textile finishing unless conversion of free formaldehyde to formic acid is promoted either in the treatment bath or in the impregnated fabric.

SUMMARY OF THE INVENTION

This invention provides a catalyst system consisting of $Al_2(OH)_5Cl$ and $H_2O_2$ which is operative at high curing temperatures for very short curing times or at curing temperatures down to 130° C. with longer curing times in treatments of cellulose-containing textiles with formaldehyde-amide adduct finishing agents to produce durable-press products. Short curing times at high temperatures, called flash curing, are employed with the use of selected crosslinking agents and the catalyst system. Among suitable finishing agents are dimethylol dihydroxyethyleneurea and dimethylol methyl carbamate. Treatment is accomplished by padding the fabric with the treatment solution, drying the fabric to remove most of the moisture, then curing the fabric.

It is thus an object of this invention to produce cellulose-containing fabrics with excellent durable-press appearance.

It is a further object to provide an improved catalyst system that is efficient and practical for use in treatments for finishing cellulose-containing textiles with certain formaldehyde-amide adduct agents.

A still further object is to furnish a catalyst system consisting of $Al_2(OH)_5Cl$ and $H_2O_2$ that will provide effective and efficient catalysis on flash curing as well as in conventional pad-dry-cure finishing.

The objects of this invention are achieved by use of the catalyst system based upon $Al_2(OH)_5Cl$ and $H_2O_2$ in treatments for cellulose-containing textiles with formaldehyde-amide adduct finishing agents. The specific combination of the $Al_2(OH)_5Cl$ and $H_2O_2$ provides efficient, rapid catalysis in flash cure processing.

DESCRIPTION OF THE PREFERRED EMBODIMENTS

We have found that a catalyst system consisting of $Al_2(OH)_5Cl$ and $H_2O_2$ is highly efficient in treatments for producing durable-press fabric but with little apparent formation of formic acid in the process. This is particularly noteworthy as anyone skilled in the art would avoid formation of a strong acid on the fabric at elevated temperatures because of the well-known deleterious effect of the hydrolytic action of strong acids on textile properties. The catalyst system consisting of $Al_2(OH)_5Cl$ and $H_2O_2$ is effective at curing temperatures up to about 200° C. A rapid, high temperature cure, hereinafter referred to as flash curing, can be accomplished at 200° C. in 10 seconds.

The catalyst system of the present invention offers the textile finisher the ability to achieve certain treatments under processing conditions previously found impossible or impractical to employ.

The catalyst system is composed of $Al_2(OH)_5Cl$ and $H_2O_2$. Concentrations of $Al_2(OH)_5Cl$ that may be used are from about 2 millimoles to about 10 millimoles for each 100 g. of treatment bath. Expressed alternatively, these concentrations are about from 0.35% to 1.75%, by weight, of the treatment bath. Hydrogen peroxide concentrations employed should be such that the molar ratio of $Al_2(OH)_5Cl$ to $H_2O_2$ is in the range of from about 1:4 to about 1:0.25. The preferred molar ratio of $Al_2(OH)_5Cl$ to $H_2O_2$is about 1:1; preferred concentrations are about 5 millimoles of each in 100 g. of treatment bath (or about 0.87% $Al_2(OH)_5Cl$ and 0.17% $H_2O_2$, by weight).

Formaldehyde-amide adduct crosslinking agents, selected from the group consisting of dimethylol dihydroxyethyleneurea, dimethylol ethyleneurea, dimethylol alkyl carbamates, dimethylol alkoxyalkyl carbamates, dimethylol hydroxyalkyl carbamates, and the esterified and etherified N-methylol derivatives thereof such as acetoxymethyl alkyl carbamates and methoxymethyl ethleneurea and the like, may be used in concentrations ranging from about 7% to about 20%, by weight, of the treatment bath.

Temperatures to achieve flash curing range from about 175° C. to about 215° C. with the preferred temperature being about 200° C. Times for flash curing may be from about 10 seconds to about 45 seconds, the preferred flash curing conditions are 20 seconds at 200° C. With suitable adjustment of processing time, lower curing temperatures, i.e., in the more conventional range of 120°-175° C., also may be employed. For example, curing at 130° C. for 3 minutes can be effectively employed with the catalyst system of this invention.

The cellulose-containing material may contain 50% or more cellulose and may be in the form of fibers, yarns, or fabrics. Fabric is the most suitable form for treatment to achieve durable-press properties.

The following examples further describe the invention. They are given as illustrations and thus should not be considered as limiting the scope of the invention. In the examples, durable-press (DP) ratings, tumble dried (TD) were determined according to the test procedure described in AATCC 124-1969, III-B.

EXAMPLE 1

Aqueous solutions were prepared such that in each 100 g. there were 9 g. of dimethylol dihydroxyethyleneurea, 5 millimoles of $Al_2(OH)_5Cl$, and 5 millimoles of $H_2O_2$ with:

Sample A—no free formaldehyde (FF) added;
Sample B—with 0.2% FF added;
Sample C—with 0.4% FF added;
Sample D—with 0.6% FF added; and
Sample E—with 0.8% FF added.

A 3.2 oz/sq. yd. cotton printcloth fabric was used for treatments. Samples were impregnated with these solutions and squeezed through pad rolls to achieve approximately 80% (by weight) wet pick-up of the treatment solution. The wet, impregnated samples were pinned on frames, then dried for 7 minutes at 60° C. and cured for 3 minutes at 140° C. Samples were then washed, tumble dried and rated for durable-press (DP) appearance.

Results are given in Table I.

TABLE I

| Sample | A | B | C | D | E |
|---|---|---|---|---|---|
| %FF added to treatment bath | 0 | 0.2 | 0.4 | 0.6 | 0.8 |
| DP rating after tumble drying | 3.3 | 3.3 | 3.3 | 3.3 | 3.3 |

This demonstrates that addition of free formaldehyde to the treatment bath containing $H_2O_2$ has no influence on improvement of durable-press appearance.

EXAMPLE 2

Aqueous solutions were prepared such that in each 100 g. there were 9 g. of dimethylol dihydroxyethyleneurea and:

Sample F—5 millimoles of $Al_2(OH)_5Cl$ and 5 millimoles of HCOOH;
Sample G—10 millimoles of $Al_2(OH)_5Cl$;
Sample H—5 millimoles of HCOOH; and
Sample I—10 millimoles of HCOOH.

A 3.2 oz/sq. yd. cotton printcloth fabric was used for the treatments. Samples were impregnated with these solutions and squeezed through pad rolls to achieve wet pick-ups of approximately 80% (by weight) of the treatment solution. The wet, impregnated fabrics were pinned on frames then dried for 7 minutes at 60° C. and cured for 3 minutes at 160° C. After curing, samples were washed, dried, and rated as in Example 1.

Results are given in Table II.

TABLE II

| Sample | F | G | H | I |
|---|---|---|---|---|
| DP rating | 4.3 | 4.3 | 1.7 | 2.4 |

No synergistic catalytic effect was obtained by adding HCOOH to $Al_2(OH)_5Cl$ as seen by comparing DP ratings of Samples F. and G. Further, it is demonstrated that HCOOH is not a satisfactory catalyst in developing suitable DP performance in the treatment of fabric with DMDHEU, see Samples H and I.

EXAMPLE 3

The use of the $Al_2(OH)_5Cl/H_2O_2$ catalyst system in finishing cotton fabric by the pad-dry-cure method with dimethylol methyl carbamate is illustrated by the data of Table III. The synergistic interaction of the catalyst components at both the 130° C. and 160° C curing temperatures should be noted.

TABLE III

| Catalyst concentration[1/] | | | | | | | | | | |
|---|---|---|---|---|---|---|---|---|---|---|
| mmol $Al_2(OH)_5Cl$ | 10 | | 7.5 | | 5 | | 2.5 | | 0 | |
| mmol $H_2O_2$ | 0 | | 2.5 | | 5 | | 2.5 | | 10 | |
| Curing temperature, ° C. | 130 | 160 | 130 | 160 | 130 | 160 | 130 | 160 | 130 | 160 |
| DP rating | 2.6 | 3.4 | 3.3 | 3.5 | 3.2 | 3.7 | 3.2 | 3.9 | 1.0 | 1.6 |

[1/]Cotton printcloth impregnated with a solution containing 10% dimethylol methyl carbamate and the indicated concentrations of $Al_2(OH)_5Cl$ and $H_2O_2$ (millimoles/100 g. solution), dried for 7 min. at 60° C., cured for 3 min. at the indicated temperature, washed, and tumble dried.

EXAMPLE 4

The use of $Al_2(OH)_5Cl$, $Al_2(OH)_5Cl/H_2O_2$, and $H_2O_2$ catalyst systems with dimethylol methyl carbamate in finishing a cotton printcloth and a 50/50 cotton/polyester percale sheeting at various times in flash curing is illustrated in Table IV.

TABLE IV

| Millimoles catalyst/100 g. bath [1/] $[Al_2(OH)_5Cl/H_2O_2]$ | Cure time, seconds | DP rating (TD) Printcloth | Sheeting |
|---|---|---|---|
| 10/0 | 5 | 1.5 | 3.3 |
| 10/0 | 10 | 2.9 | 3.3 |
| 10/0 | 20 | 3.0 | 3.7 |
| 10/0 | 30 | 3.3 | 3.9 |
| 5/5 | 5 | 2.7 | 3.3 |
| 5/5 | 10 | 3.3 | 4.2 |
| 5/5 | 20 | 3.7 | 4.5 |
| 5/5 | 30 | 4.0 | 4.5 |
| 0/10 | 5 | 1.3 | 2.7 |
| 0/10 | 10 | 1.4 | 3.0 |
| 0/10 | 20 | 1.4 | 3.0 |
| 0/10 | 30 | 1.5 | 3.2 |

[1/] Fabric impregnated with a solution containing 10% dimethylol methyl carbamate and the indicated concentration of $Al_2(OH)_5Cl$ and $H_2O_2$, dried for 7 min. at 60° C., flash cured at 200° C., washed and dried.

The superior catalytic action afforded through the synergistic effect of the catalyst mixture should be particularly noted.

EXAMPLE 5

The use of the $Al_2(OH)_5Cl/H_2O_2$ catalyst system in finishing cotton printcloth and a 50/50 cotton/polyester percale sheeting with dimethylol methyl carbamate by flash curing is illustrated in Table V. Improvement in durable-press appearance is achieved with concentrations of $Al_2(OH)_5Cl$ and $H_2O_2$ as low as 2.5 millimoles of each per 100 g. of treatment bath.

TABLE V

| | | | | |
|---|---|---|---|---|
| Mmol $Al_2(OH)_5Cl$ | 2.5 | 5.0 | 7.5 | 10 |
| Mmol $H_2O_2$ | 2.5 | 5.0 | 7.5 | 10 |
| DP rating(TD) | | | | |
| Printcloth [1/] | 3.3 | 3.3 | 4.0 | 4.3 |
| Sheeting | 3.7 | 4.3 | 4.0 | 4.5 |

[1/] Fabric impregnated with a solution of 10% dimethylol methyl carbamate and the indicated concentration of catalyst per 100 g. of bath, dried for 7 min. at 60° C., cured for 15 seconds at 200° C., washed, and tumble dried.

EXAMPLE 6

Catalyst systems incorporating the oxidizing agents, $K_2S_2O_8$ or $(NH_4)_2S_2O_8$, and $Al_2(OH)_5Cl$ with dimethylol methyl carbamate in finishing a cotton printcloth resulted in fabric discoloration as seen in Table VI.

TABLE VI

| Millimoles catalyst/100 g. bath[1/] | DP rating | Coloration |
|---|---|---|
| $Al_2(OH)_5Cl/K_2S_2O_8$ | 3.5 | Very light |

TABLE VI-continued

| Millimoles catalyst/100 g. bath[1/] | DP rating | Coloration |
|---|---|---|
| (5/5) | | yellow |
| $Al_2(OH)_5Cl/(NH_4)_2S_2O_8$ (5/5) | 4.3 | Light yellow |

[1/] Fabric impregnated with a solution containing 10% dimethylol methyl carbamate and the indicated catalyst, dried for 7 min. at 60° C., flash cured 15 seconds at 200° C., washed and tumble dried.

This demonstrates that oxidizing agents other than $H_2O_2$ are not suitable in flash curing for producing durable-press fabrics without fabric discoloration.

We claim:

1. In a process for imparting durable-press properties to cellulosic textiles, said process of the type wherein the textile is impregnated with an aqueous formulation containing a formaldehyde-amide adduct crosslinking agent and aluminum chlorhydroxide catalyst, and is dried and cured, the improvement characterized by:

adding hydrogen peroxide to the formulation to provide a more efficient, activated catalyst system that promotes the finishing reaction through synergistic interaction of the aluminum chlorhydroxide and hydrogen peroxide.

2. An improved process for imparting durable-press properties to cotton and other cellulose-containing textiles, the process comprising:

a. impregnating a textile which contains at least 50% cellulose with an aqueous formulation consisting of:
   1. about 7–20%, by weight, of a formaldehydeamide adduct crosslinking agent,
   2. about from 0.35% to 1.75%, by weight (about 2 to 10 mmol. per 100 g. of formulation), of aluminum chlorhydroxide
   3. an amount of hydrogen peroxide so that the molar ratio of aluminum chlorhydroxide to hydrogen peroxide is about from 1:4 to 1:0.25, and
   4. water, as the remainder of the formulation, and
b. drying and curing the wet impregnated textile of (a) by heat treatment, to obtain durable press-properties in the textile.

3. The process of claim 2 wherein a flash-curing step is achieved by heat treatment at about from 175° to 215° C. for about 10 to 45 seconds.

4. The process of claim 2 wherein curing is achieved by heat treatment at about from 120° to 175° C. for about 3 minutes.

5. The process of claim 2 wherein the formaldehydeamide adduct crosslinking agent is dimethylol dihydroxyethyleneurea.

6. The process of claim 2 wherein the formaldehydeamide adduct crosslinking agent is dimethylol methyl carbamate.

* * * * *